US010773362B2

(12) United States Patent
Howard

(10) Patent No.: US 10,773,362 B2
(45) Date of Patent: Sep. 15, 2020

(54) PIVOTABLE VISE, CLAMPING ATTACHMENTS FOR THE VISE, AND RELATED METHODS

(71) Applicant: Jeffrey E. Howard, Missoula, MT (US)

(72) Inventor: Jeffrey E. Howard, Missoula, MT (US)

( * ) Notice: Subject to any disclaimer, the term of this patent is extended or adjusted under 35 U.S.C. 154(b) by 249 days.

(21) Appl. No.: 15/428,450

(22) Filed: Feb. 9, 2017

(65) Prior Publication Data

US 2017/0232580 A1 Aug. 17, 2017

Related U.S. Application Data

(60) Provisional application No. 62/295,372, filed on Feb. 15, 2016.

(51) Int. Cl.

| | |
|---|---|
| ***B25B 1/22*** | (2006.01) |
| ***B25B 1/02*** | (2006.01) |
| ***B25B 1/24*** | (2006.01) |
| ***B25B 5/00*** | (2006.01) |
| ***B25B 5/10*** | (2006.01) |
| ***B25B 1/10*** | (2006.01) |
| *B25B 5/16* | (2006.01) |

(52) U.S. Cl.

CPC ..... *B25B 1/22* (2013.01); *B25B 1/103* (2013.01); *B25B 1/2436* (2013.01); *B25B 5/003* (2013.01); *B25B 5/10* (2013.01); *B25B 5/102* (2013.01); *B25B 5/163* (2013.01)

(58) Field of Classification Search

CPC ..... B25B 1/2405; B25B 1/2452; B25B 5/163; B25B 1/22; B25B 1/00; B25B 1/02; B25B 1/103; B25B 1/2436; B25B 1/2431; B25B 1/04; B25B 1/2442; B25B 1/2447; B25B 1/2426; B25B 5/04; B25B 5/062; B25B 5/064; B25B 13/28; B25B 13/505; B25B 13/5058; B25B 1/08; B25B 13/18; B25B 13/24; B25B 13/32; B25B 13/38; B25B 5/102; B25B 5/006; F16M 11/10

USPC ..... 269/257, 258, 233, 87.2, 71, 166, 4, 57, 269/59, 81, 55

See application file for complete search history.

(56) References Cited

U.S. PATENT DOCUMENTS

| | | | | |
|---|---|---|---|---|
| 979,305 A | | 12/1910 | Hunt | |
| 1,269,271 A | | 6/1918 | Fegley et al. | |
| 1,306,858 A | | 6/1919 | Salter | |
| 1,537,958 A | | 5/1925 | Franklin | |
| 2,353,891 A | * | 7/1944 | Gruntorad | B25B 1/22 188/67 |

(Continued)

FOREIGN PATENT DOCUMENTS

| | | | |
|---|---|---|---|
| DE | 2539613 | * | 3/1977 |
| FR | 318342 | | 10/1902 |

OTHER PUBLICATIONS

"Zyliss Profi-King Plus Vise," Feb. 26, 2009 for toolboxblog.com, http://toolboxblog.com/2009/02/26/zyliss-profi-king-plus-vise/.

*Primary Examiner* — Monica S Carter
*Assistant Examiner* — Mahdi H Nejad
(74) *Attorney, Agent, or Firm* — Dorsey & Whitney LLP

(57) ABSTRACT

Embodiments disclosed herein generally relate to a pivotable clamp or vise. For example, the vise may clamp or secure a workpiece at a suitable position and/or orientation.

20 Claims, 13 Drawing Sheets

(56) References Cited

U.S. PATENT DOCUMENTS 2,371,435 A * 3/1945 Galorneau ..... B25B 1/22 269/71
2,564,566 A * 8/1951 Duffy ..... B23Q 1/5406 269/71
3,021,132 A * 2/1962 Jesionowski ..... B25B 1/22 269/251
4,132,397 A 1/1979 Ward
4,240,621 A * 12/1980 Daddato ..... B25B 1/20 269/264
4,315,494 A * 2/1982 DiPlacido ..... B28D 7/043 125/13.01
4,681,309 A * 7/1987 Lechner ..... A61G 13/12 5/646
4,779,857 A 10/1988 Maund
5,270,911 A * 12/1993 Maglica ..... B62J 6/00 248/288.51
6,029,965 A * 2/2000 Lee ..... B25B 1/22 269/139
6,098,366 A * 8/2000 Guichard ..... E04B 1/0046 403/230
6,135,435 A * 10/2000 Schmitz ..... B25B 1/103 269/164
6,338,478 B2 1/2002 Baculy
6,494,445 B1 * 12/2002 Bellis, Jr. ..... B25B 5/006 269/4
7,159,859 B2 1/2007 Fuller
8,197,304 B2 * 6/2012 Hummel ..... B24D 15/06 451/380
8,888,084 B1 * 11/2014 Aldredge ..... B25B 1/103 269/166
10,307,892 B1 * 6/2019 Schaefer ..... B25B 1/22
2004/0046091 A1 * 3/2004 Chuang ..... B25B 1/22 248/125.1
2009/0002261 A1 * 1/2009 Bohm ..... F16M 11/10 343/882

* cited by examiner

PIVOTABLE VISE, CLAMPING ATTACHMENTS FOR THE VISE, AND RELATED METHODS

CROSS-REFERENCE TO RELATED APPLICATIONS

This application claims priority to U.S. Provisional Application No. 62/295,372 filed on 15 Feb. 2016, the disclosure of which is incorporated herein, in its entirety, by this reference.

BACKGROUND

Various devices and mechanisms may be used for securing workpieces in a manner that facilitates fabrication of various parts therefrom. For example, a vise or a clamp may be used to secure a workpiece while a user machines, carves, shapes, or otherwise manufactures a part or product from the workpiece. More specifically, securing workpieces in vises and/or clamps allows a manufacturer to perform various operations on the workpiece, while maintaining the workpiece in a selected position.

Accordingly, users and manufacturers of vises and clamps continue to seek improvements thereto.

SUMMARY

Embodiments disclosed herein generally relate to a pivotable clamp or vise. For example, the vise may clamp or secure a workpiece at a suitable position and/or orientation. Moreover, one or more portions of the vise may be reconfigured (e.g., pivoted) to reorient and/or reposition the workpiece to one or more suitable angles and/or positions (e.g., relative to a support or a user). In particular, for example, the vise may be pivoted to a selected angle relative to a horizontal plane and may be selectively secured in the pivoted position, such that the workpiece secured in the vise is oriented at a selected or suitable orientation (e.g., relative to the user). For example, reorienting the pivoting portion(s) of the vise may lift or remove the workpiece that is secured in the vise from one or more support surfaces (e.g., in a first orientation of the vise, one or more surfaces of the workpiece may be at least partially supported by or lie on at least one support surface, and in a second orientation of the vise, the workpiece may be distanced from the support surfaces).

Embodiments include a pivotable vise that includes a mounting bracket and a clamping assembly pivotably secured to the mounting bracket and configured to pivot about a pivot axis relative to the mounting bracket. The mounting bracket includes a mounting plate sized and configured to be secured to a support and a guide plate secured to the mounting plate. The clamping assembly includes an elongated bar pivotably secured to the mounting bracket, a movable jaw operably connected to the elongated bar, a back jaw operably connected to the elongated bar, and a locking mechanism configured to secure the elongated bar at a selected angle relative to the guide plate of the mounting bracket.

Embodiments also include a clamping system that includes a support and the vise according to one or more embodiments described herein secured to the support.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Embodiments disclosed herein generally relate to a pivotable clamp or vise. For example, the vise may clamp or secure a workpiece at a suitable position and/or orientation. Moreover, one or more portions of the vise may be reconfigured (e.g., pivoted) to reorient and/or reposition the workpiece to one or more suitable angles and/or positions (e.g., relative to a support or a user). In particular, for example, the vise may be pivoted to a selected angle relative to a horizontal plane and may be selectively secured in the pivoted position, such that the workpiece secured in the vise is oriented at a selected or suitable orientation (e.g., relative to the user). For example, reorienting the pivoting portion(s) of the vise may lift or remove the workpiece that is secured in the vise from one or more support surfaces (e.g., in a first orientation of the vise, one or more surfaces of the workpiece may be at least partially supported by or lie on at least one support surface, and in a second orientation of the vise, the workpiece may be distanced from the support surfaces).

Embodiments also include vise jaws configured to secure workpieces that may have various non-uniform surfaces and/or shapes. For example, at least one of the vise jaws may be configured to pivot in a manner that at least partially aligns or orients the surface of the vise jaw with the surface of the workpiece. In some embodiments, the workpiece may be secured to a pivotable holder that may be clamped by and between the vise jaws. For example, the pivotable holder may be oriented at any suitable orientation (e.g., relative to a support surface or user) in three-dimensional space, as described below in more detail.

Figure 1A:
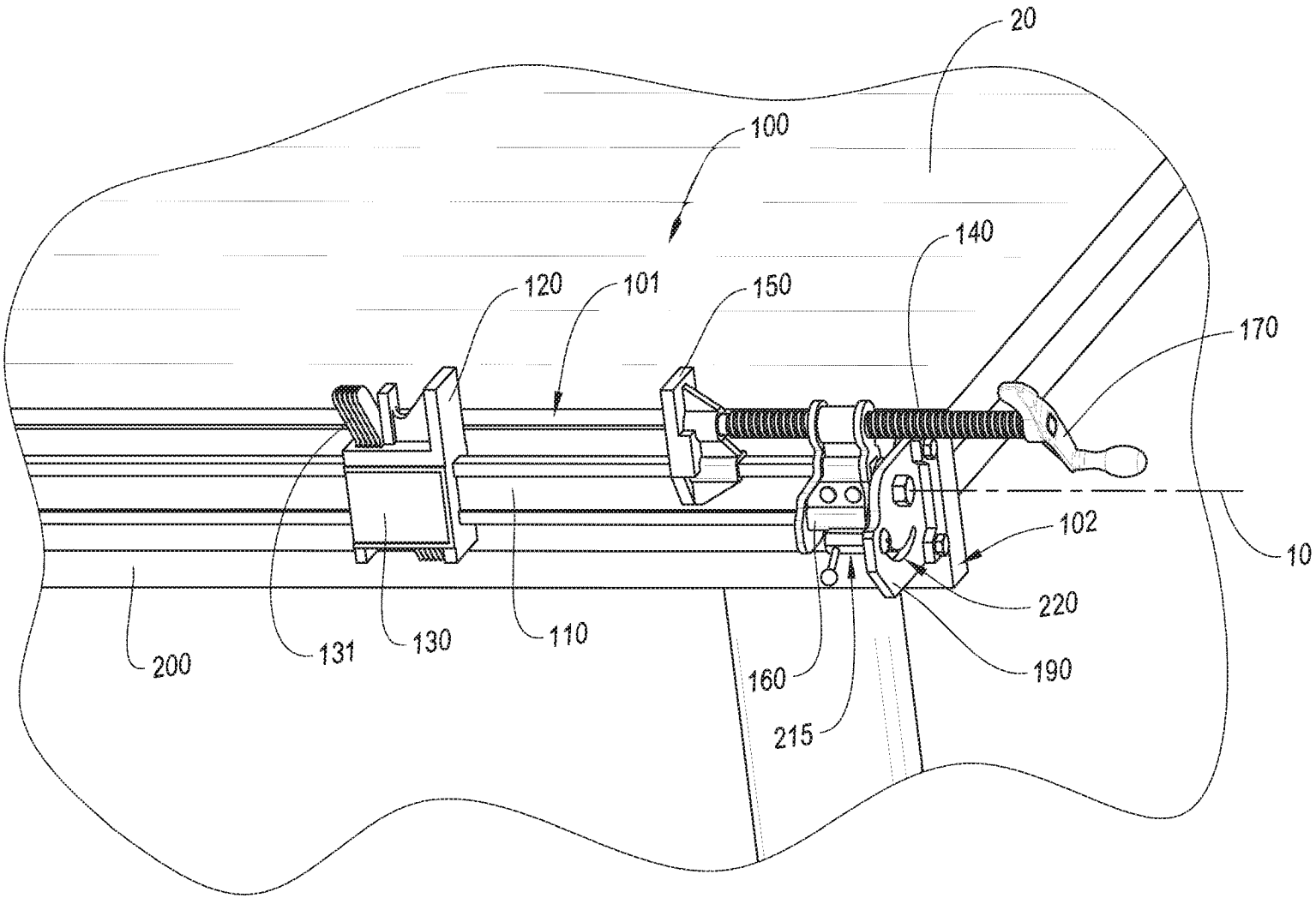
FIG. 1A is a front, isometric view of a vise according to an embodiment.
Figure 2:
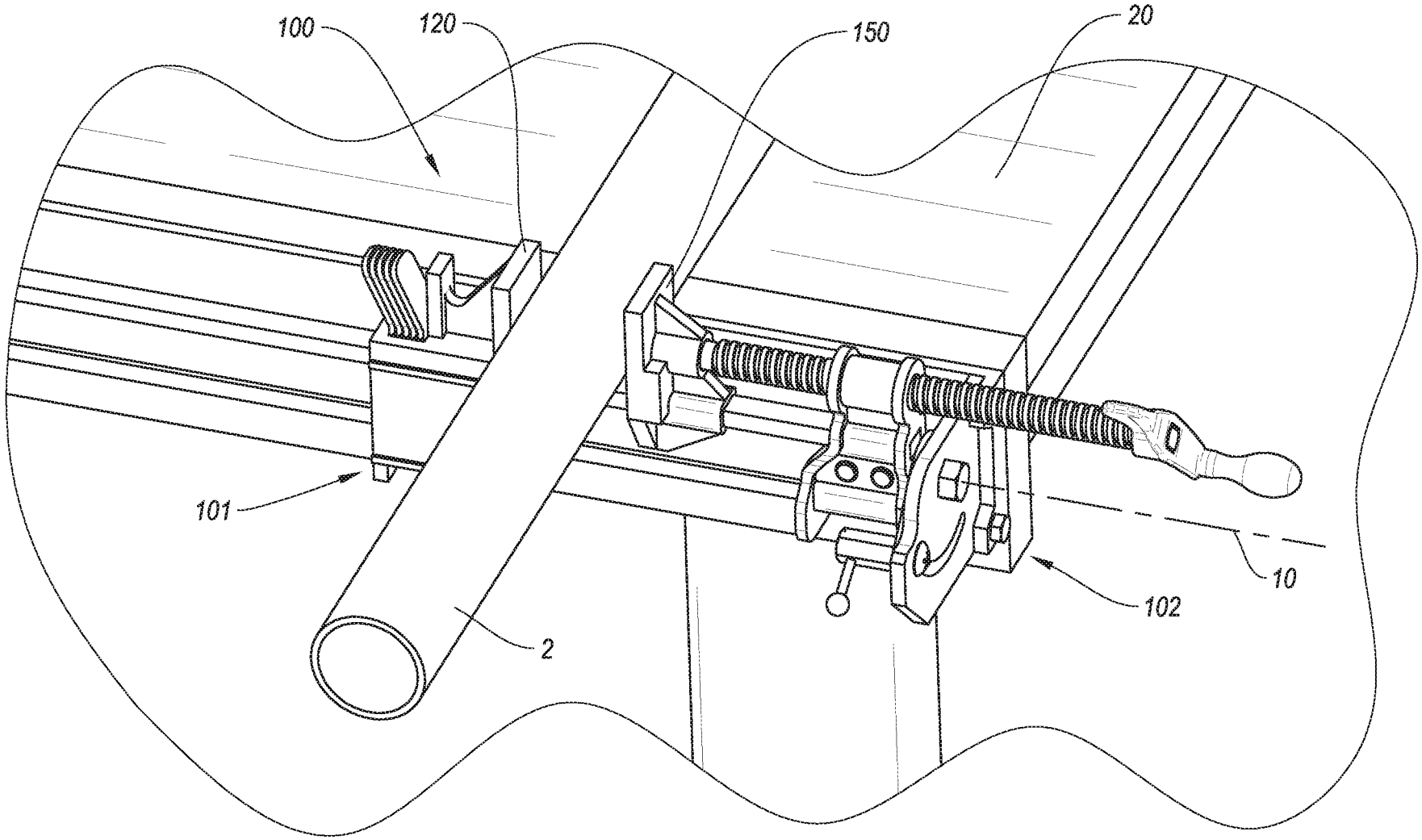
FIG. 2 is a front, isometric view of the vise of FIG. 1A securing a workpiece according to an embodiment.

Generally, in one or more embodiments, a vise 100 is attachable to a support (e.g., a table), as shown in FIG. 1A. In the illustrated embodiment, the vise 100 includes a clamping assembly 101 pivotably connected to a mounting bracket 102. More specifically, for example, the clamping assembly 101 may secure or clamp a workpiece (e.g., workpiece 2, as shown in FIG. 2). In an embodiment, the clamping assembly 101 together with the secured workpiece 2 may be pivoted relative to the mounting bracket 102 and/or may be secured in a selected pivoted orientation. As described below in more detail, the mounting bracket 102 may include one or more elements or components that may be sized and configured to be secured to one or more supports (e.g., the mounting bracket shown in FIG. 1A includes a mounting plate 200 that may be attached to a support, such as a table 20). For example, the mounting bracket 102 may include one or more openings or holes; one or more corresponding fasteners may pass through the holes in the bracket 102 and fasten the bracket to the support (e.g., the fasteners may include screws that may screw into a side of a table).

The clamping assembly 101 may include any number of suitable clamping and/or fastening mechanisms that may vary from one embodiment to the next. In the illustrated embodiment, the clamping assembly includes a bar 110, a back jaw 120 operably connected to the bar 110, and a repositionable head 130 that may be integrated with the back jaw 120. The clamping assembly 101 also may include a vise screw 140 and a movable jaw 150 operably connected to the vise screw 140. In an embodiment, the vise screw 140 may be operably connected to a stationary head 160. For example, the stationary head 160 may include a threaded hole or a nut that may accept the vise screw 140, such that rotation of the vise screw 140 inside the threaded hole produces linear movement of the vise screw relative to the stationary head 160 together with the movable jaw 150. The stationary head 160 may be connected to or integrated with the bar 110, such that the stationary head 160 may remain substantially fixed relative to the bar 110 as the vise screw 140 rotates and moves the movable jaw 150 relative to the stationary head 160 and relative to the bar 110.

Under some operating conditions, rotation of the vise screw 140 may move the movable jaw 150 toward the back jaw 120 to clamp a workpiece and may move away from the back jaw 120 to unclamp the workpiece. In any event, the movable jaw 150 may be operated to selectively clamp (or secure) a workpiece in the clamping assembly 101 and unclamp (or release) the workpiece from the clamping assembly 101. Moreover, it should be appreciated that the clamping assembly 101 may include any suitable clamping mechanism, such as a toggle clamp, spring clamp, etc., which may secure a workpiece thereto.

The repositionable head 130 may be positioned and secured at a selected location along the bar 110 (e.g., along the length of the bar 110). In particular, selecting a position for the repositionable head 130 along the bar 110 may also select the distance between the back jaw 120 and the movable jaw 150 (e.g., to accommodate a workpiece). In an embodiment, a locking element 131 may secure the repositionable head 130 to the bar 110. For example, the locking element 131 may be spring-loaded and may press against the bar 110, such that the friction between the locking element and the bar retains the repositionable head 130 substantially fixed relative to the bar 110. Additionally or alternatively, the bar 110 may include one or more notches, cavities, or holes, and the locking element 131 may be selectively positioned inside a notch, cavity, or hole on the bar 110 in the manner that would lock or secure the repositionable head 130 to the bar 110 and prevent relative movement thereof.

In the illustrated embodiment, the locking element 131 may be pivoted such as to reduce the friction between the bar 110 and the locking element 131 (e.g., such that the locking element no longer contacts the bar 110) to allow the repositionable head 130 to move along the bar 110 and to be positioned at a selected location thereon. Additionally or alternatively, the locking element may be a fastener, a snap ring, a pin (that may fit into an opening in the bar), etc. In any event, the repositionable head 130 and the back jaw 120 may be substantially fixed or stationary relative to the bar 110 (e.g., when secured at the selected location), such that a workpiece may be secured between the back jaw 120 and the movable jaw 150 by advancing the movable jaw 150 toward the back jaw 120 and clamping the workpiece between the back jaw 120 and the movable jaw 150.

In the illustrated embodiment, the clamping assembly 101 includes a handle 170 operably connected to the vise screw 140 or integrated therewith. Specifically, rotating the handle 170 may correspondingly rotate the vise screw 140 and produce a linear movement of the movable jaw 150 toward or away from the back jaw 120. For example, the vise screw 140 may have a right-handed thread, and clockwise rotation of the handle 170 and vise screw 140 may advance the movable jaw 150 toward the back jaw 120 (e.g., to clamp a workpiece), while counterclockwise rotation of the handle 170 and vise screw 140 may move the movable jaw 150 away from the back jaw 120 (e.g., to unclamp the workpiece).

As described above, the clamping assembly 101 may pivot relative to the mounting bracket 102. In an embodiment, the vise may include a pivoting mechanism securing the clamping assembly 101 to the mounting bracket 102, such that the clamping assembly 101 may pivot relative to the mounting bracket 102 and/or may be fixed at a selected angle relative thereto. For example, the clamping assembly 101 may pivot relative to the mounting bracket about a pivot axis 10. In the illustrated embodiment, the pivot axis 10 is oriented generally horizontally (e.g., leveled relative to a horizontal plane that is oriented perpendicularly to the gravitational vector), and the bar 110 extends lengthwise along the pivot axis 10. It should be appreciated, however, that the pivot axis 10 may have any number of suitable orientations that may vary from one embodiment to another.

Figure 1B:
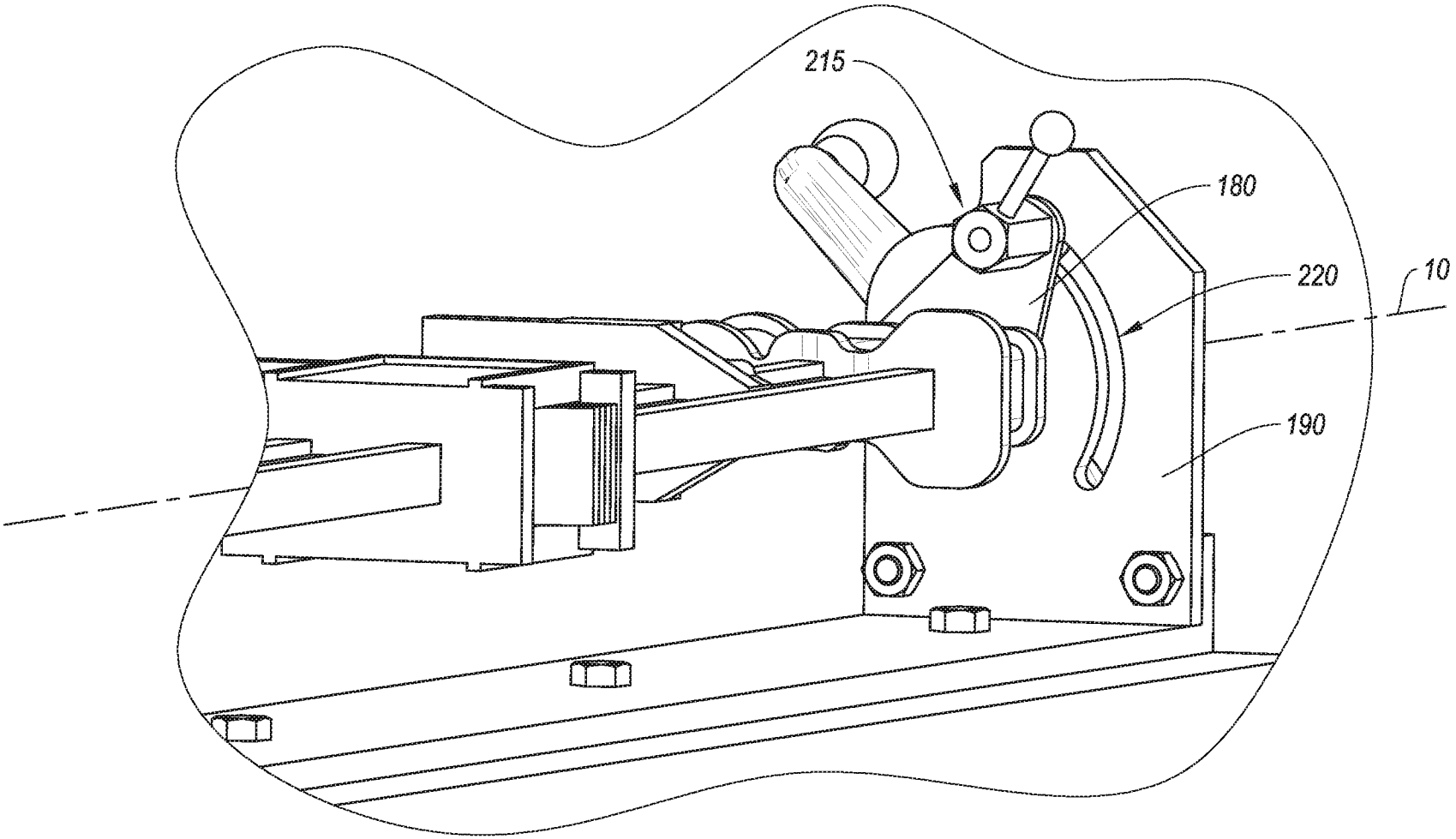
FIG. 1B is a bottom, isometric view of the vise of FIG. 1A.

In an embodiment, as shown in FIGS. 1A-1B, the pivoting mechanism may include a pivot arm 180 of the clamping assembly 101 pivotably connected to a guide plate 190 of the mounting bracket 102. The pivot arm 180 may be connected to or integrated with the stationary head 160 and/or with the bar 110. The guide plate 190 may be connected to and/or integrated with the mounting plate 200 of the mounting bracket 102. Hence, for example, pivoting the pivoting arm 180 relative to the guide plate 190 may pivot the bar 110, the back jaw 120, and the movable jaw 150 (and the workpiece secured thereby) relative to the mounting plate 200.

In an embodiment, at least one pivot member 210 (e.g., a shaft, a fastener, such as a threaded shaft or a bolt, a dowel, etc.) may form a pivot axis about which the clamping assembly 101 may pivot relative to the mounting bracket 102. Moreover, the pivot member 210 may pivotably secure the clamping assembly 101 to the mounting bracket 102. For example, the bar 110 and/or the pivot arm 180 (of the clamping assembly 101) and the guide plate 190 (of the mounting bracket 102) may include openings and the pivot member may extend through the openings, pivotably securing the clamping assembly 101 to the mounting bracket 102.

Generally, the clamping assembly 101 and the mounting bracket 102 may extend from proximal ends (e.g., near the handle 170) to opposing distal ends. For example, the proximal and distal ends of the clamping assembly 101 may be pivotably connected to the respective proximal and distal ends of the mounting bracket 102. In some embodiments, pivot members (e.g., similar to or the same as the pivot member 210) may connect the respective proximal and distal ends of the clamping assembly 101 and the mounting bracket 102, such that the clamping assembly 101 may pivot relative to the mounting bracket 102 about the pivot axis 10.

In some embodiments, the pivot member 210 may secure or fix the clamping assembly 101 at a selected orientation relative to the mounting bracket 102. For example, as mentioned above, the pivot member 210 may be a fastener (e.g., a threaded fastener, such as a screw, a shoulder screw, etc.) and the bar 110, the stationary head 160, the pivot arm 180, or combinations thereof may include a threaded hole or a nut that may accept the threaded pivot member 210, such as a screw. In an embodiment, the pivot member 210 that has a threaded portion may be tightened of fastened to the mounting bracket 102 (e.g., to secure together the bar 110, the stationary head 160, the pivot arm 180, or combinations thereof to the guide plate 190, thereby securing the clamping assembly 101 at a selected orientation or angle relative to the mounting bracket 102.

In the illustrated embodiment, the guide plate 190 includes a channel 220 and the vise 100 includes a nut and bolt assembly 215 that is at least partially positioned inside the channel 220 and secures together the guide plate 190 and the pivot arm 180. For example, the channel 220 may extend through the guide plate 190 and may have a generally arcuate or semi-circular shape (e.g., the semi-circular channel may be centered about the pivot axis 10). The nut and bolt assembly 215 may include a bolt that extends through the channel 220 and is fastened with the nut, such that tightening together the nut and bolt secures or fixes together the guide plate 190 and the pivot arm 180, thereby securing together the clamping assembly 101 and the mounting bracket 102. Hence, for example, tightening the nut and bolt may secure together the pivot arm 180 and the guide plate 190, and loosening the nut and bolt may release the pivot arm 180 from the guide plate 190, thereby allowing the clamping assembly to pivot relative to the guide plate and relative to the mounting bracket.

Generally, however, it should be appreciated that the vise 100 may include any number of suitable locking mechanisms that may secure the clamping assembly 101 to the mounting bracket 102 (e.g., at selected relative orientations) in a manner that permits selective pivoting of the clamping assembly 101 relative to the mounting bracket 102, and which may vary from one embodiment to another. Moreover, in one or more embodiments, the channel 220 may be replaced by a plurality of through holes located along a selected path (e.g., along an arcuate path), and the nut and bolt assembly 215 may be replaced by a spring-loaded pin that serves as a detent mechanism that can be selectively inserted in the corresponding hole to adjust the pivot angle of the clamping assembly 101.

In an embodiment, the channel 220 may limit the pivot angle to any suitable angle. The limiting angle or the angle that the clamping assembly 101 may pivot relative to the mounting bracket 102 may, generally, vary from one embodiment to the next. For example, the channel 220 may limit pivoting of the clamping assembly 101 relative to the mount bracket 102 to 45 degree pivot angle, 90 degree pivot angle (e.g., as in the illustrated embodiment), 180 degree pivot angle, etc. In some embodiments, the channel 220 may permit indexing or pivoting the clamping assembly 101 between two selected positions relative to the mounting bracket 102.

In an embodiment, the nut and bolt assembly 215 may be offset from the pivot axis 10. For example, affixing together the nut and bolt and securing together the pivot arm 180 and the guide plate 190 at the location offset from the pivot axis 10 may provide leverage to resist pivoting of the clamping assembly 101 relative to the mounting bracket 102 (e.g., compared with securing the clamping assembly 101 relative to the mounting bracket 102 at or near the pivot axis 10). Hence, for example, the vise 100 may secure a suitably weighted workpiece at a selected angular orientation relative, such that the workpiece remains suitably fixed or stationary relative to the mounting bracket 102.

Generally, the various elements and components of the vise 100 may be fabricated from any number of suitable materials that may vary from one embodiment to the next. Moreover, where suitable, the elements and/or components of the vise 100 may be machined from solid blocks or billets or may be cast, molded, or extruded. For example, the repositionable head 130 and/or the stationary head 160 may be cast (e.g., from iron, zinc, etc.) and the bar 110 may be extruded or rolled (e.g., rolled steel), and the pivot arm 180 and the guide plate 190 may be machined. Furthermore, materials suitable for the various elements and components of the vise, generally, include steel, iron, aluminum, brass, wood, plastic, etc., and may vary from one embodiment to the next (e.g., depending on the applications or uses intended for the vise).

In an embodiment, the vise 100 may be attached or secured to a support. For example, in the illustrated embodiment, the vise 100 is attached to a table 20. Specifically, the mounting bracket 102 is attached to the table 20 and secures the vise 100 thereto. Hence, for example, pivoting the clamping assembly 101 relative to the mounting bracket 102 pivots the clamping assembly 101 relative to the table 20. As mentioned above, however, the vise 100 may be mounted to and/or placed on any suitable support (or on no support) and may be oriented at any suitable orientation.

Moreover, as described above the clamping assembly 101 may be pivotably attached to the mounting bracket 102. For example, the mounting bracket 102 may include the guide plate 190 and an opposing back plate 191 connected to the mounting plate 200, and the bar 110 of the clamping assembly 101 may be pivotable secured to and between the guide plate 190 and the back plate 191. In the illustrated embodiment, the guide plate 190 and the back plate 191 are removably fastened to the mounting plate 200. For example, the guide plate 190 and the back plate 191 may have the same fastening connections (e.g., the same or suitably similar bolt patterns), such that the back plate 191 and the guide plate 190 may be interchangeably mounted or fastened to the mounting plate 200. In particular, for example, swapping mounting locations of the back plate 191 and the guide plate 190 (e.g., as compared to the example shown in FIGS. 1A-1B) facilitates securing the vise 100 on an opposite side of the table or a similar support structure. That is, the vise 100 may have a mirrored configuration as compared to the illustrated embodiment.

Again, pivoting the clamping assembly 101 relative to the mounting bracket 102 may pivot the workpiece secured by the clamping assembly 101 relative to the mounting bracket 102. As described above, FIG. 2 illustrates the workpiece 2 (a pipe) secured by the clamping assembly 101. In particular, the workpiece 2 is clamped by and between the back jaw 120 and the movable jaw 150. In some operating conditions, the workpiece 2 may be placed on the surface of the support (e.g., on the top surface of the table 20) and positioned such as to extend between the back jaw 120 and the movable jaw 150. As shown in FIG. 2, the clamping assembly 101 may clamp the workpiece 2 between the back jaw and the movable jaw 150, while the workpiece 2 is at least partially supported by the top surface of the table 20. It should be appreciated that the surface of the support (supporting the workpiece 2) may vary from one embodiment to the next and may have any suitable shape, size, and configuration (e.g., may be planar, arcuate, etc.).

Figure 3A:
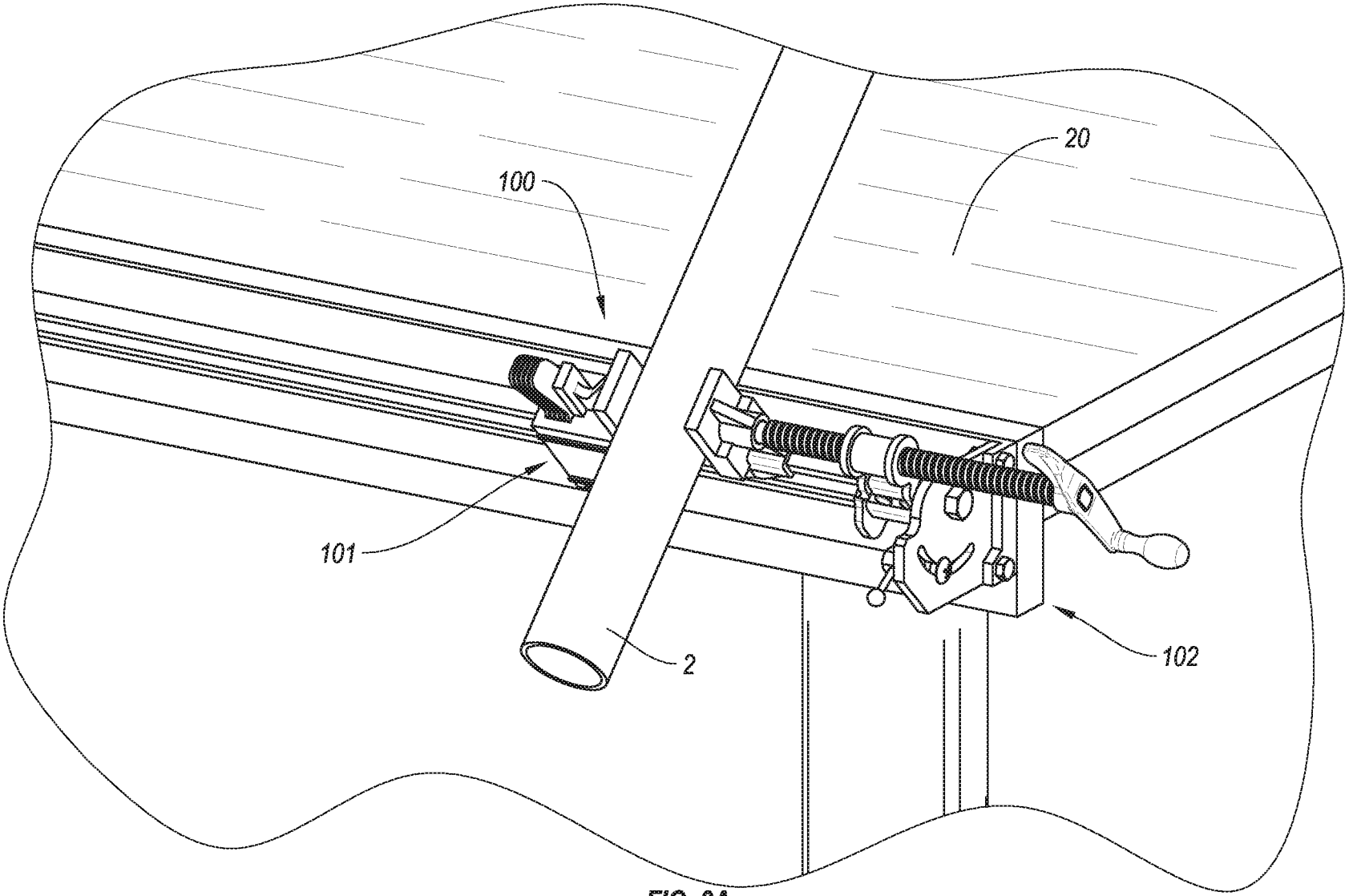
FIG. 3A is a front, isometric view of the vise of FIG. 1A securing a workpiece according to another embodiment.
Figure 3B:
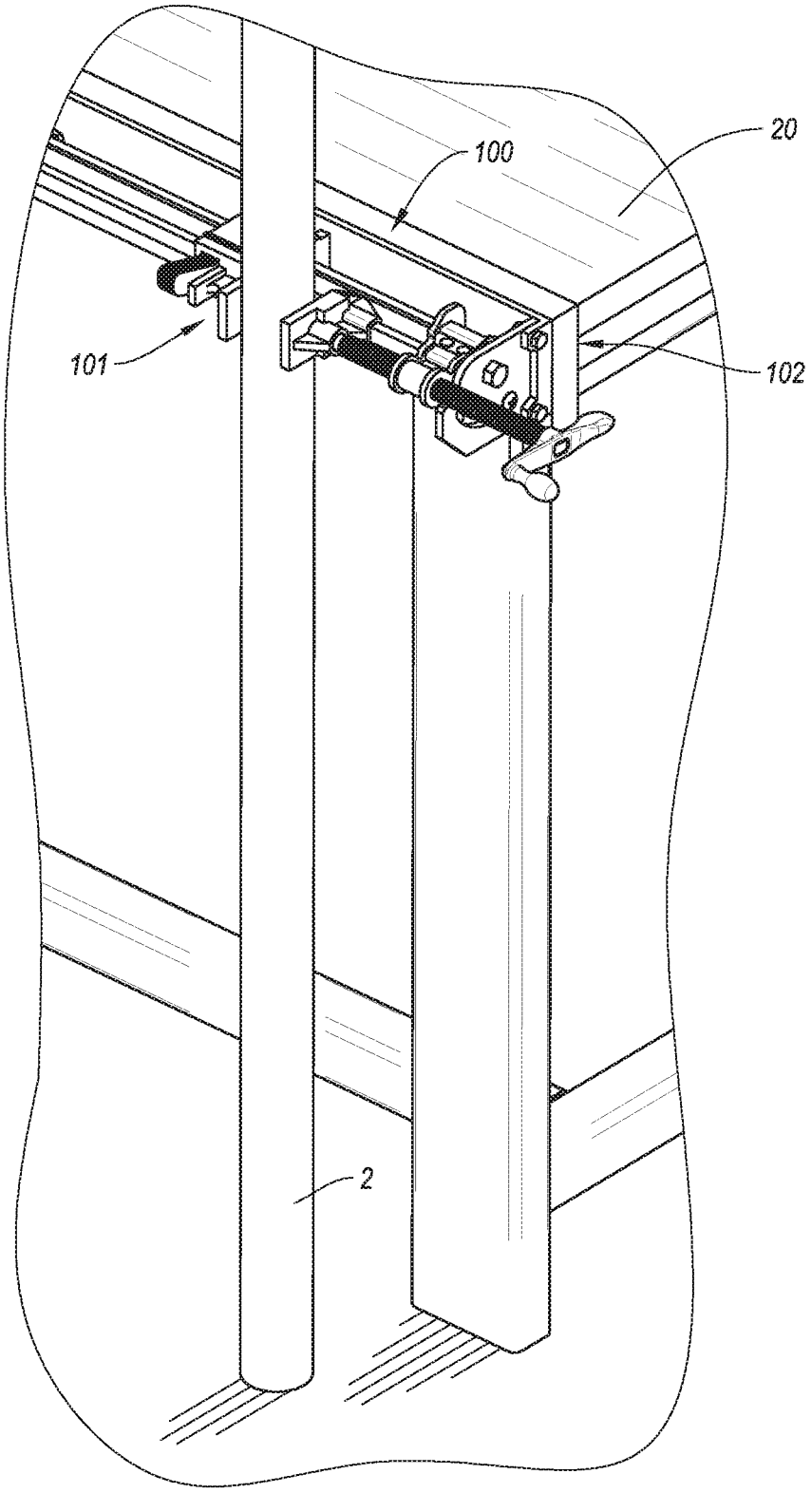
FIG. 3B is a front, isometric view of the vise of FIG. 1A securing a workpiece according to yet another embodiment.

As shown in FIGS. 3A-3B, the clamping assembly 101 together with the workpiece 2 may be pivoted relative to the mounting bracket 102 and relative to the table 20. Moreover, the workpiece 2 may be pivoted together with the clamping assembly 101 to any suitable angle and secured at such angle (as described above). Hence, for example, the workpiece 2 may be first placed or positioned on a support surface (e.g., on a generally horizontal surface, such as the top surface of the table 20), as shown in FIG. 2 and may be secured in the vise 100 and lift or pivoted away from the support surface together with the clamping assembly 101, as shown in FIGS. 3A-3B, such that the workpiece is distanced or spaced away from the support surface.

Generally, the back jaw 120 and/or the movable jaw 150 of the vise 100 may have any suitable size and/or configuration, which may vary from one embodiment to another. For example, the clamping surface of the back jaw 120 and of the movable jaw 150 may be generally planar and/or generally parallel to each other. Moreover, in at least one embodiment, the clamping surfaces of the back jaw 120 and/or the movable jaw 150 may be generally perpendicular to the support surface and/or perpendicular to the pivot axis 10. In some embodiments, the vise may include removable clamping attachments and/or fixtures that may change the size of the jaw(s), shape of the jaw(s), operation or movement of the jaw(s), etc.

Figure 4A:
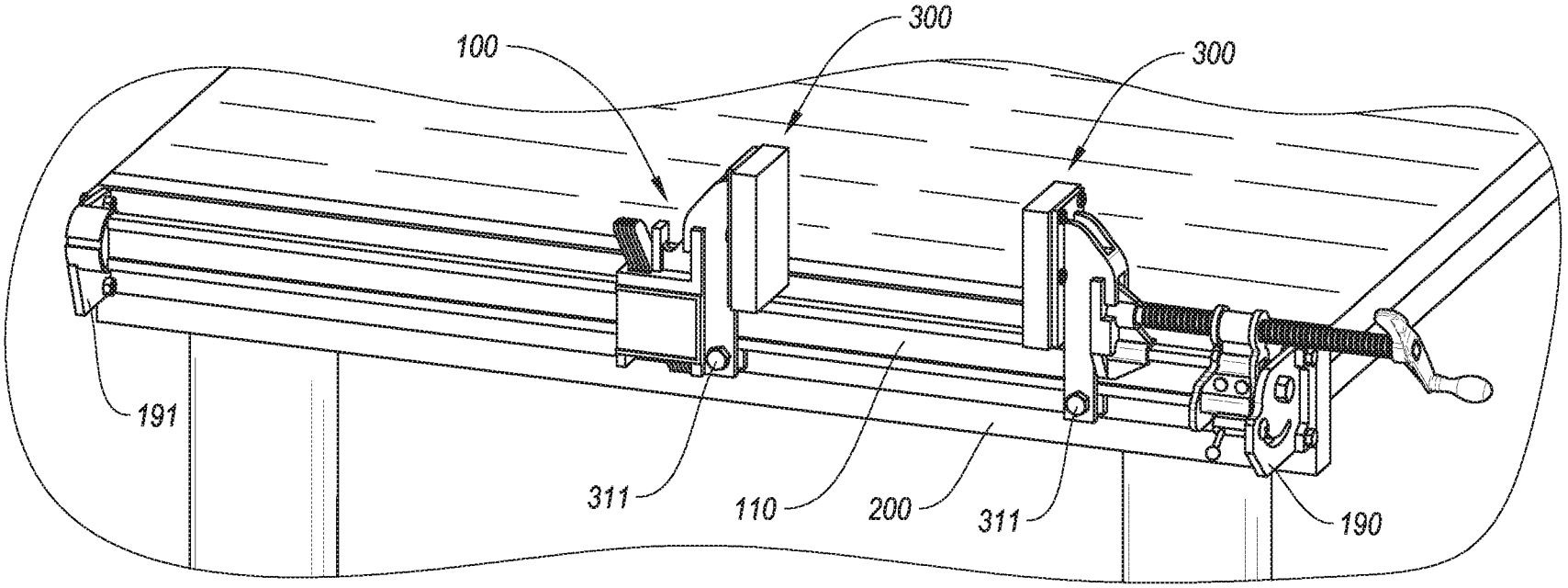
FIG. 4A is a front, isometric view of the vise of FIG. 1A with clamping attachments according to an embodiment.
Figure 4B:
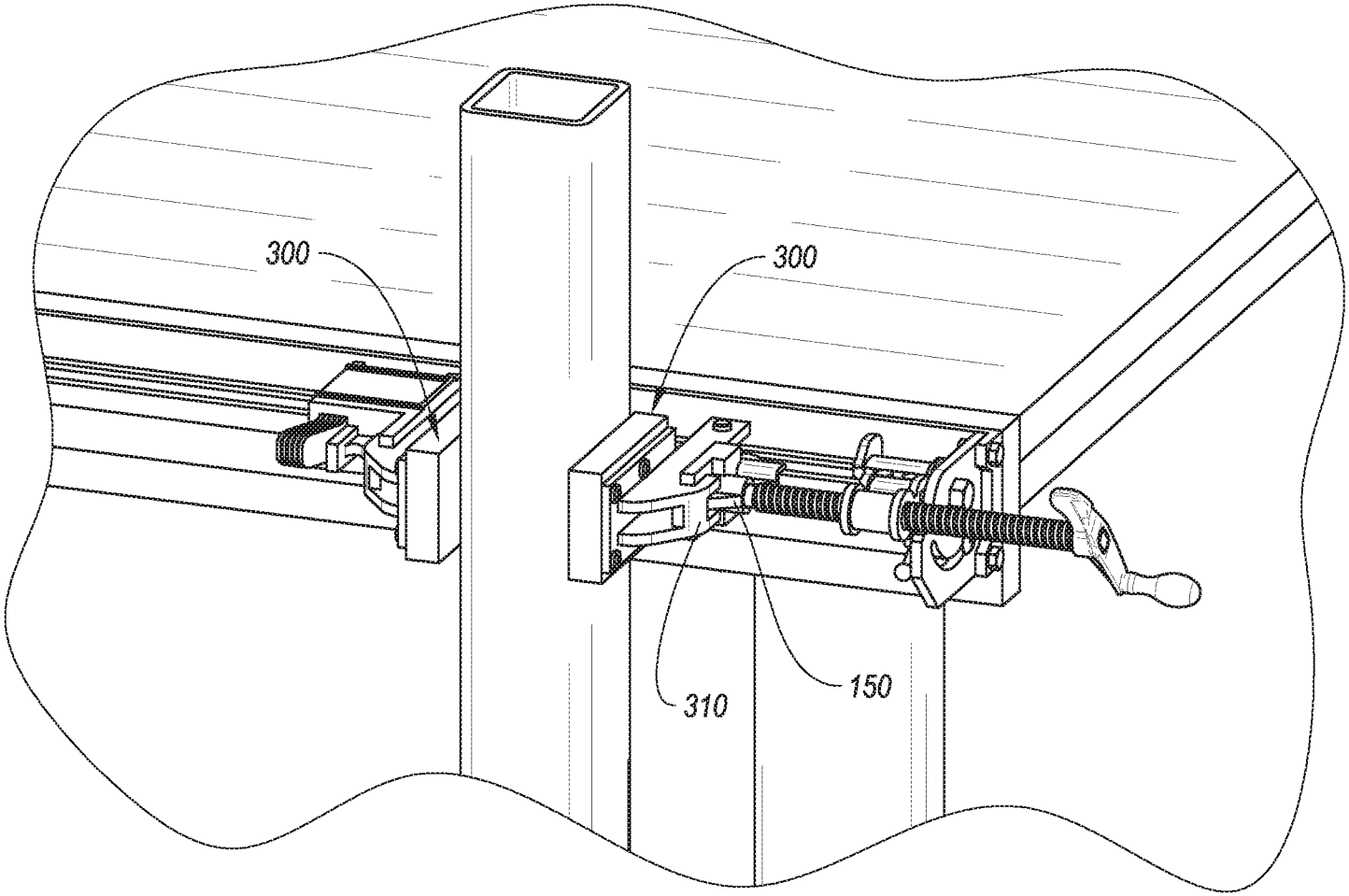
FIG. 4B is a front, isometric view of the vise of FIG. 4A securing a workpiece according to an embodiment.
Figure 4C:
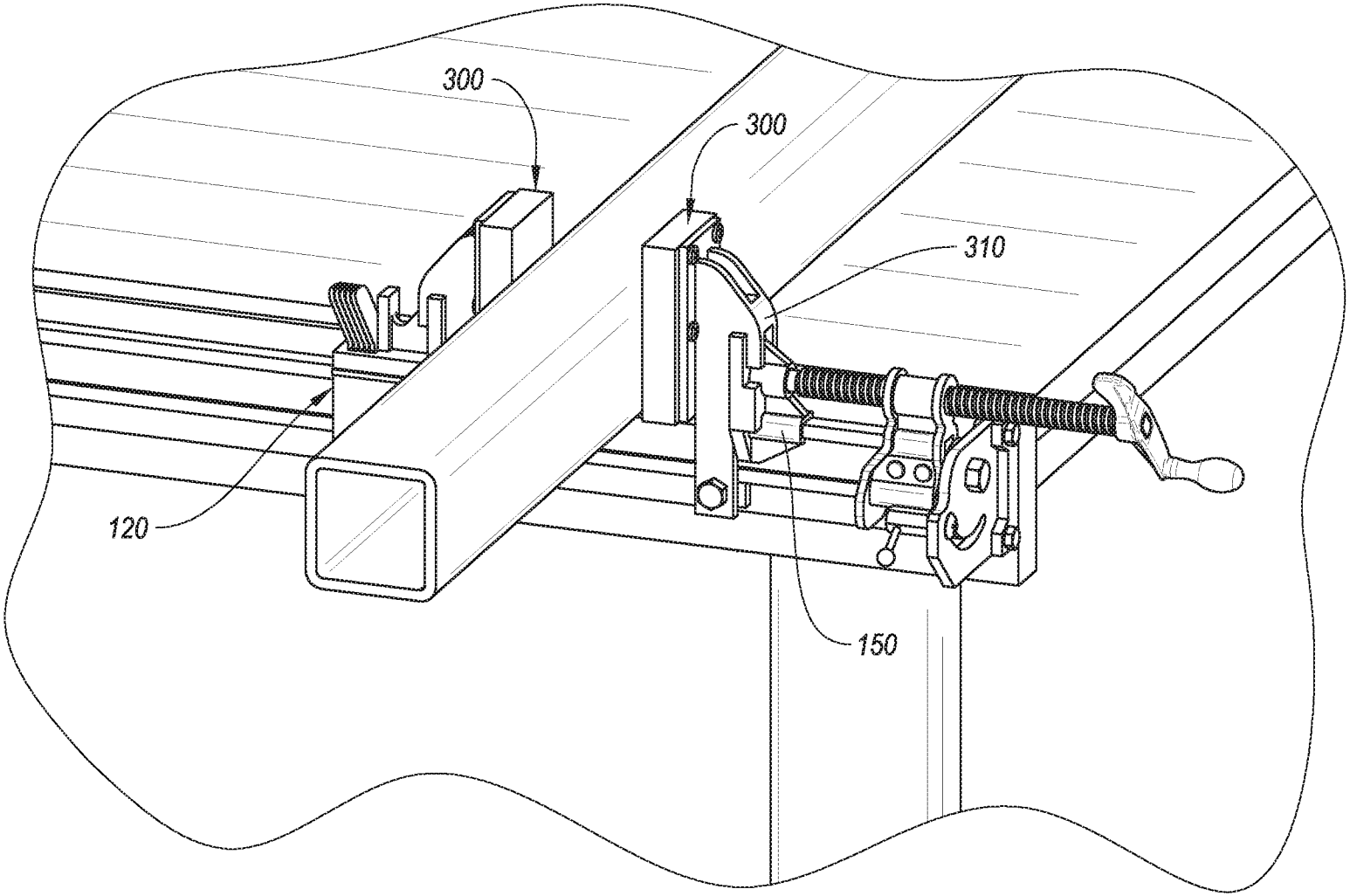
FIG. 4C is a front, isometric view of the vise of FIG. 4A securing a workpiece according to another embodiment.

FIGS. 4A-4C illustrate removable clamping attachments 300 that may be removably secured to the back jaw 120 and/or to the movable jaw 150. For example, the clamping attachments 300 may have one or more slots defined by a lip 310, which may be fitted over the back jaw 120 and/or the movable jaw 150. In an embodiment, the clamping surface of the back jaw 120 and/or the movable jaw 150 may be defined or formed by jaw plates, and the clamping attachments 300 may be fitted over the jaw plates, such that the jaw plates fit into the slots in the clamping attachments 300.

For example, the clamping attachments 300 may have clamping surfaces that have larger area than the clamping surfaces of the back jaw 120 and/or movable jaw 150, thereby applying a more distributed pressure on the workpiece, such as to limit or avoid damaging the workpiece. Moreover, the clamping surface of the clamping attachments 300 may include or may be formed from any suitable material. For example, the clamping surface of the clamping attachments 300 may include material that is softer than the material of the clamping surfaces of the back jaw 120 and/or movable jaw 150 (e.g., the clamping surface of the back jaw 120 and/or movable jaw 150 may be formed by metal plates, such as steel plates, and the clamping surfaces of the clamping attachments 300 may be formed by polymer plates or blocks, such as wood plates, plastic plates, etc.).

Also, as described below in more detail, the vise 100 may include any number of suitable and/or removable jaw or clamping attachments. In the illustrated embodiment, the clamping attachments include stabilizers 311 that may extend under the bar 110, such as to prevent or limit tipping or tilting (relative to the axis of the bar 110) of the attachments when pressure is applied thereto. Hence, for example, the stabilizers 311 may facilitate maintaining the clamping surfaces of the clamping attachments 300 at approximately parallel orientation relative to each other.

Figure 5:
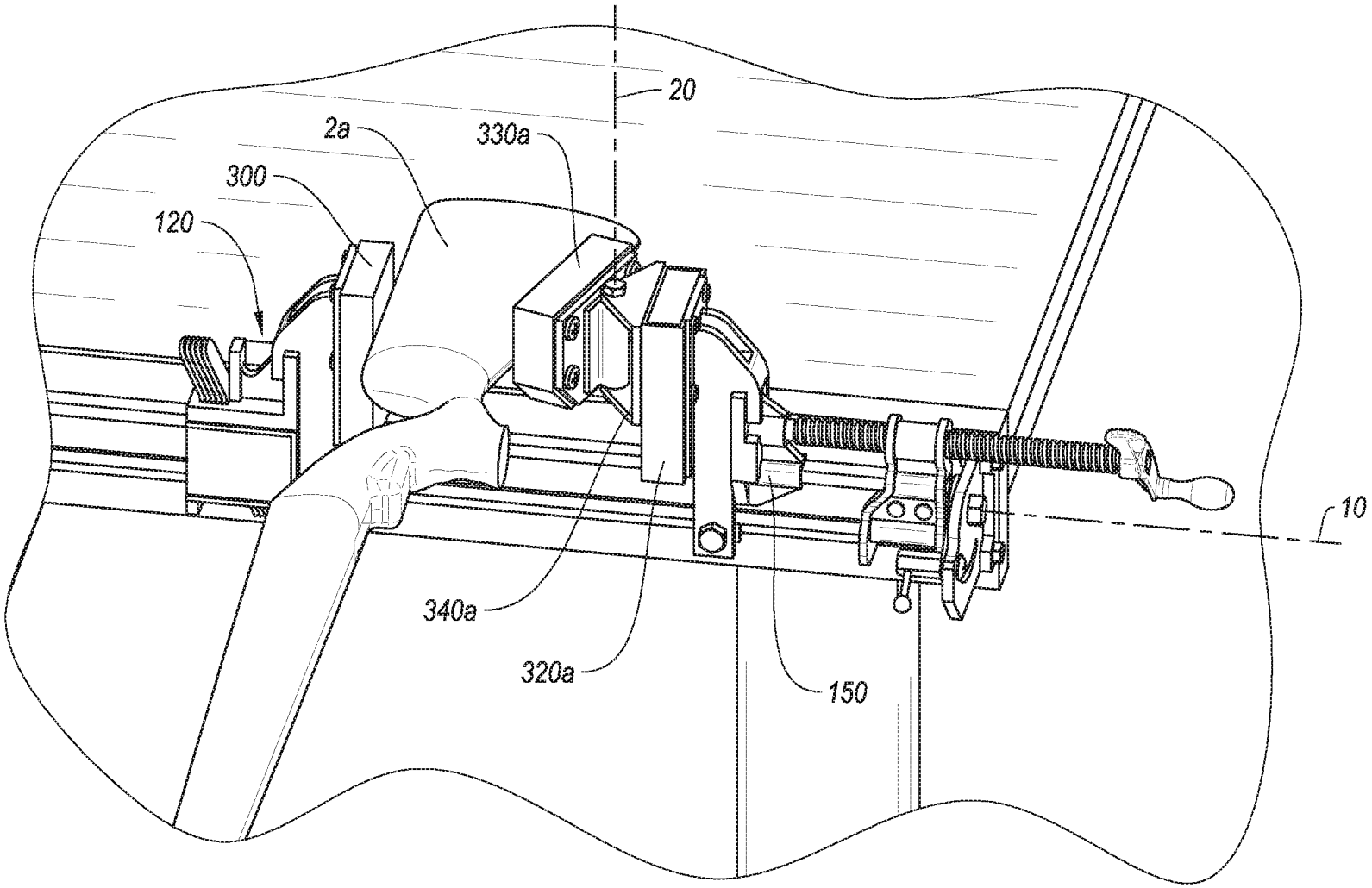
FIG. 5 is a front, isometric view of the vise of FIG. 1A with clamping attachments according to an embodiment.

Additionally or alternatively, according to at least one embodiment, the vise may include at least one pivotable clamping attachment that may include one or more pivotable jaws that are configured to pivot relative to a stationary portion of the clamping assembly. FIG. 5 is an isometric view of a vise that includes a pivotable clamping attachment 300*a* removably secured to the movable jaw 150, according to an embodiment. In the illustrated embodiment, the vise 100 has the clamping attachment 300 secured to the back jaw 120. It should be appreciated that, as described below in more detail, the pivotable clamping attachment 300*a* may be removably secured to the back jaw 120.

The pivotable clamping attachment 300*a* may include a jaw that may pivot about a jaw axis 20. In some embodiments, the jaw axis 30 may be substantially perpendicular to the pivot axis 10 of the clamping assembly and/or substantially perpendicular relative to the longitudinal axis of the bar 110 and/or relative to the movement of the movable jaw 150. The pivotable clamping attachment 300*a* may include a base 320*a* that may be removably attached to a jaw of the clamping assembly (e.g., to the movable jaw 150) and a pivotable jaw 330*a* pivotably secured to the base 320*a*.

In some embodiments, the pivotable clamping attachment 300*a* may include a standoff 340*a* that may be secured to the base 320*a*, and the pivotable jaw 330*a* may be pivotably secured to the standoff 340*a* (e.g., such as to pivot about the jaw axis 20). For example, the standoff 340*a* may define a space between the base 320*a* and the pivotable jaw 330*a* that may facilitate pivoting of the pivotable jaw 330*a* to a selected pivot angle relative to the base 320*a* and to the opposing clamping surface of the clamping assembly, such as the clamping surface of the back jaw 120 and/or of the clamping attachment 300 of the clamping assembly and/or relative the movable jaw 150. For example, pivoting the pivotable jaw 330*a* may allow the clamping surface of the pivotable jaw 300*a* better conform to one or more contour of the surfaces of the workpiece and to accommodate clamping of the workpiece.

Generally, the pivotable jaw 330*a* may pivot to any suitable angle relative to the opposing jaw (or clamping surface of the opposing jaw) and to the longitudinal axis of the clamping assembly (e.g., relative to the axis that is substantially parallel to the pivot axis 10). For example, the pivotable jaw 330*a* may pivot in a manner that facilitates clamping a workpiece that has non-parallel opposing sides and/or sides that have irregular shapes. In the illustrated example, workpiece 2*a* is clamped by pressing against two opposing surface thereof that have non-parallel relative orientation. Pivoting the pivotable jaw 330*a*, orients the clamping surface of the pivotable jaw 330*a* to be more parallel to the corresponding surface of the workpiece engaged thereby to facilitate better clamping (compared to a non-pivoting jaw).

Figure 6:
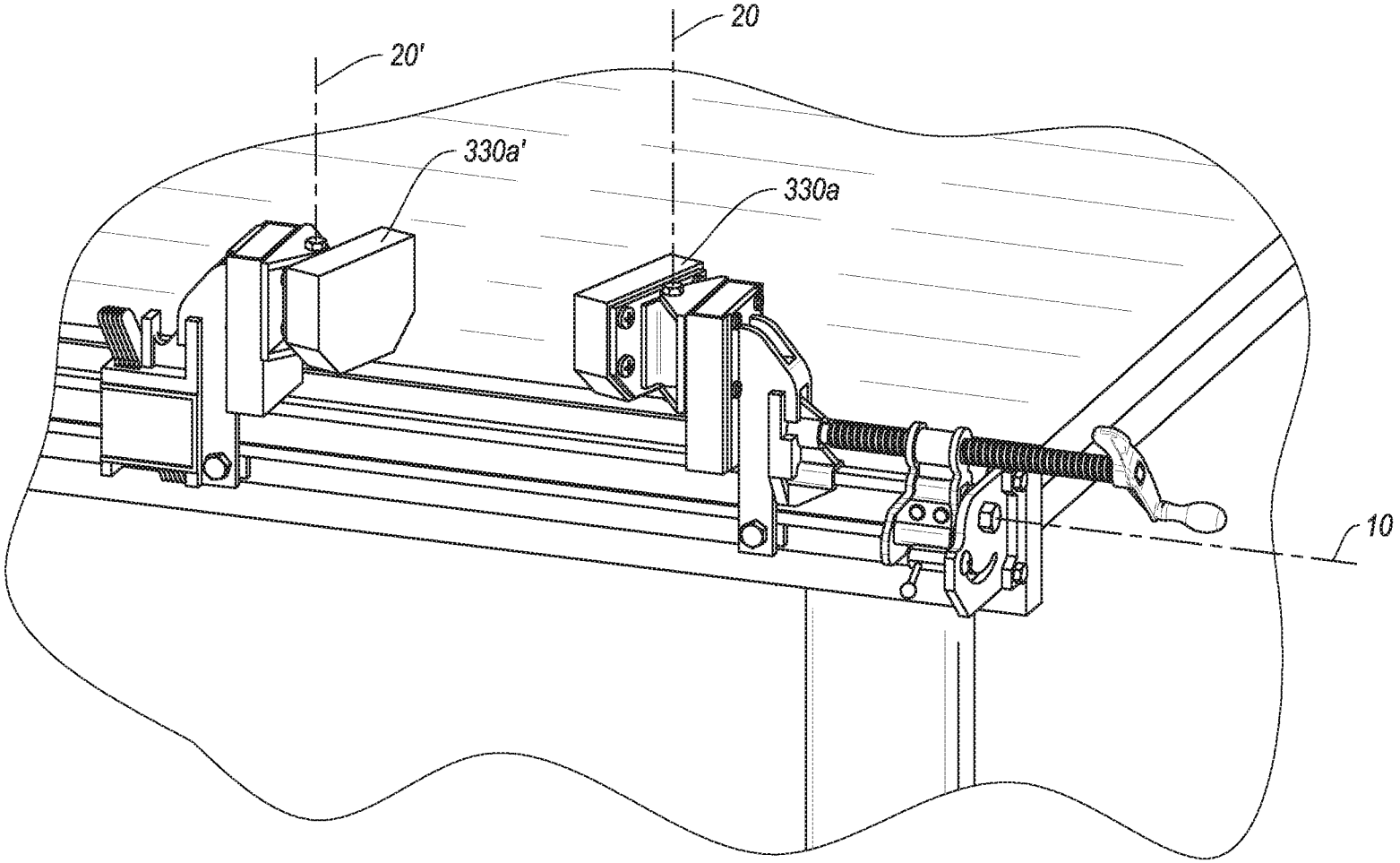
FIG. 6 is a front, isometric view of the vise of FIG. 1A with clamping attachments according to another embodiment.

Moreover, as shown in FIG. 6, the vise may include opposing pivotable jaws, such as the pivotable jaw 330*a* and pivotable jaw 330*a*'. Specifically, the pivotable jaw 330*a* may pivot about the jaw axis 30 and the pivotable jaw 330*a* may pivot about jaw axis 20'. For example, the jaw axis 30 may be generally parallel to the jaw axis 30'. Furthermore, in some embodiments, the jaw axis 30 may be aligned with the jaw axis 30' (e.g., such that both jaw axis 30, 30' intersect pivot axis 10, an axis parallel to the pivot axis, or an axis parallel to the movement of the movable jaw 150). Alternatively, the jaw axes 20, 20' may be offset from each other (e.g., may intersect two different axes that are parallel to the pivot axis 10, an axis parallel to the pivot axis, or an axis parallel to the movement of the movable jaw 150).

Figure 7A:
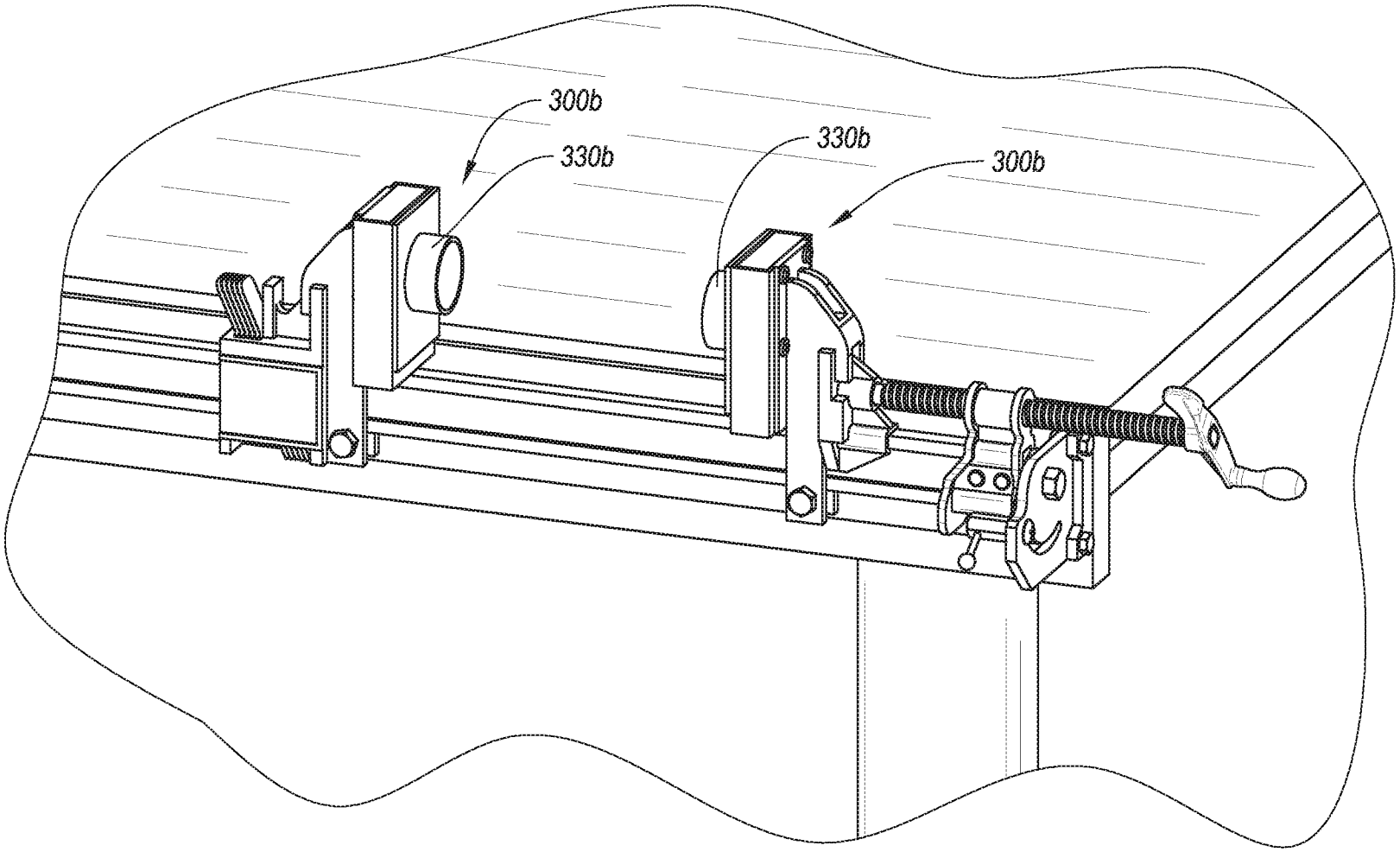
FIG. 7A is a front, isometric view of the vise of FIG. 1A with clamping attachments according to another embodiment.
Figure 7B:
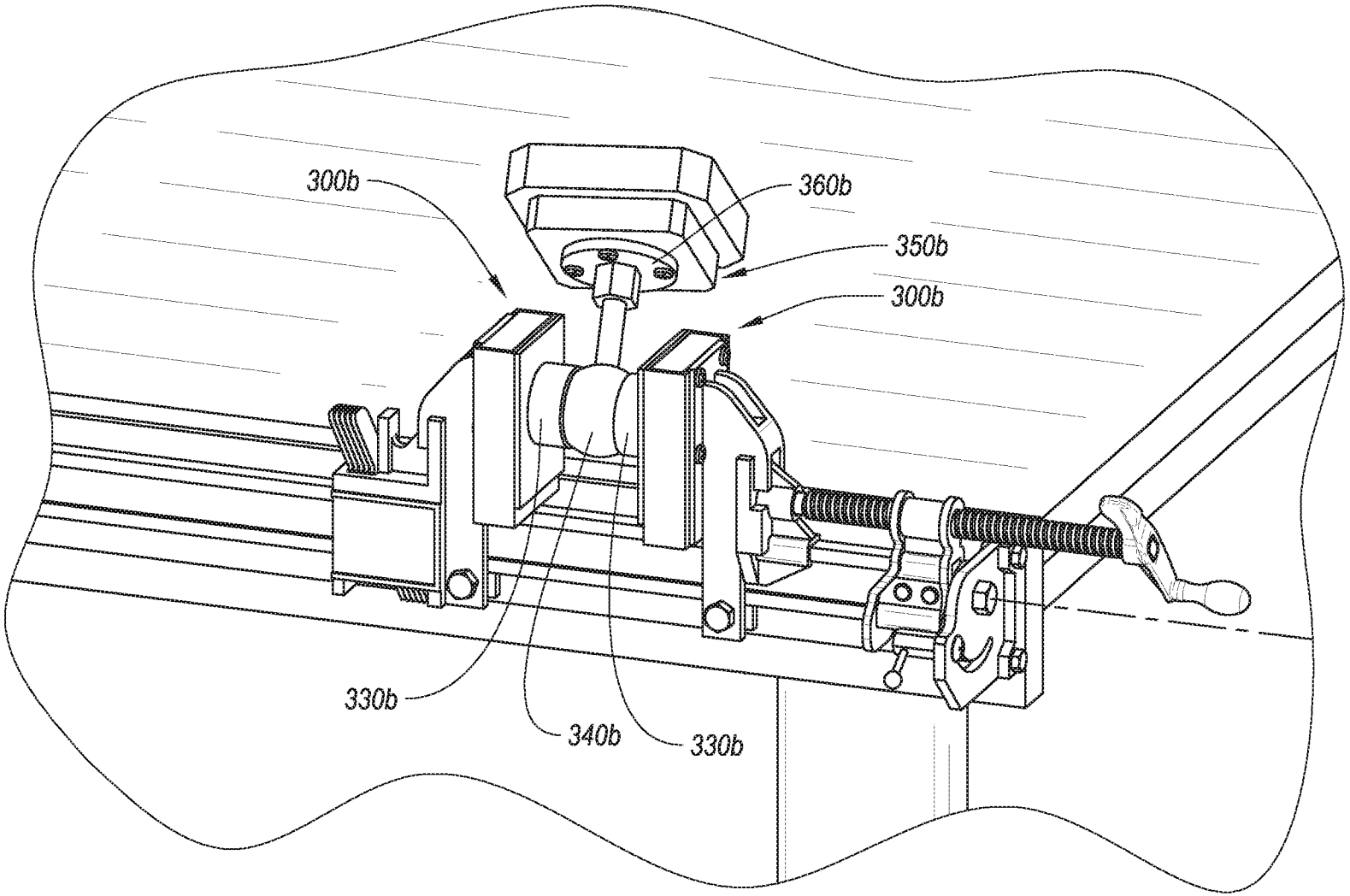
FIG. 7B is a front, isometric view of the vise of FIG. 7 with a fixture secured between clamping attachments according to an embodiment.

According to an embodiment, as shown in FIGS. 7A-7B, the vise may include ball-joint clamping attachments 300*b* that are configured to secure a work piece in any orientation. In particular, the ball-joint clamping attachments 300*b* may include opposing cup-shaped jaws 330*b* that are configured to be secured to the movable jaw 150 and/or to the back jaw 120. The cup-shaped jaws include cups that are sized and configured to clamp and secure a spherical portion or semi-spherical portion 340*b* of a fixture 350*b*.

In an embodiment, the fixture 350*b* may include a base 360*b*, and the semi-spherical portion 340*b* may extend outward from the base 360*b*. For example, the fixture 350 may include a shaft 341*b* operably connected to the base 360*b*, and the semi-spherical portion 350*b* may be connected to and/or integrated with the shaft 341*b*). Hence, securing the semi-spherical portion 340*b* of the fixture 350*b* in the clamping assembly of the vise also may secure the fixture 350 relative to the clamping assembly.

Generally, the base 360*b* may secure or may be secure to one or more portions of a workpiece. In the illustrated example, the base 360*b* is attached directly to the workpiece (e.g., the base 360*b* may be attached with fasteners). Additionally or alternatively, the base 360*b* may include one or more vise or clamps secured thereto, which may clamp the workpiece, thereby securing the workpiece to the fixture 350*b*.

The fixture 350*b* may be oriented or pivoted to any angle in three-dimensional space or multiple/compound angles relative to the back jaw 120 and/or movable jaw 150 and to the pivot axis 10 or any other reference surface or reference axis. Hence, the fixture 350*b* and the workpiece may be clamped at any selected orientation, thereby positioning the workpiece at a suitable orientation. In addition, the fixture may be partially unclamped, such that the clamping assembly at least partially secures the spherical portion of the fixture 350*b* and supports the workpiece, and the fixture 350*b* may be pivoted relative to the back jaw 120 and movable jaw 150.

Figure 8:
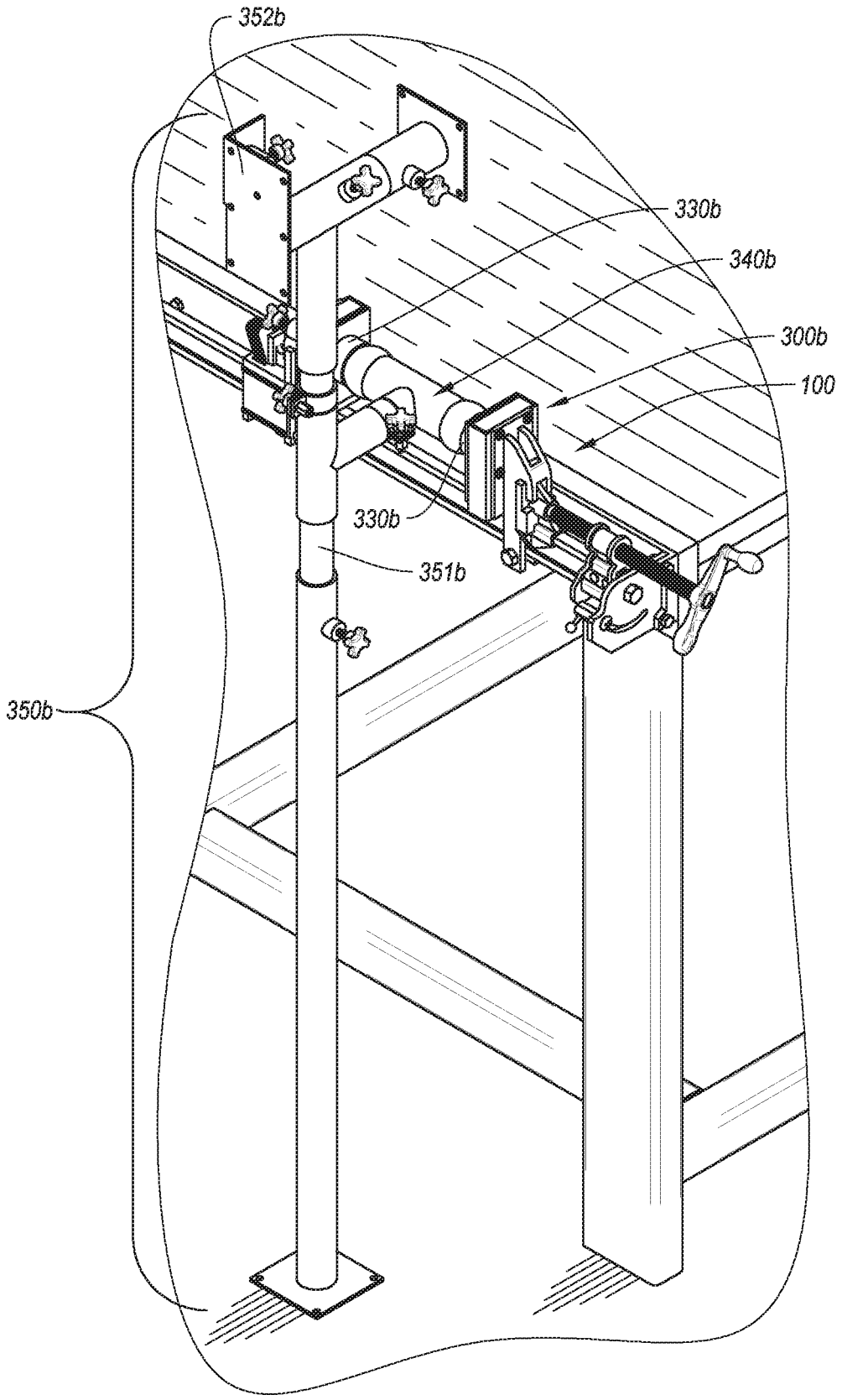
FIG. 8 is a front, isometric view of the vise of FIG. 7 with a fixture secured between clamping attachments according to another embodiment.

Furthermore, as shown in FIG. 8, cup jaws 330*b* may secure an elongated member 340*b* (e.g., a pipe, a rod, etc.) with opposing semispherical or ball-like ends, which may be included or integrated into one or more additional or alternative fixtures. For example, the elongated member 340*b* may be operably connected to a fixture 350*b*. Generally, the elongated member 340*b* may be connected to the fixture 350*b* with any number of suitable connectors or connection mechanisms. For example, the elongated member 340*b* may be welded, fastened, or otherwise secured together with the fixture 350.

Moreover, the fixture 350*b* may vary from one embodiment to the next. In the illustrated embodiment, the fixture 350*b* includes an extension member 351*b*. For example, the extension member 351*b* may provide additional support to one or more workpiece secured in or to the fixture 350*b*. In an embodiment, the extension member 351*b* may be extended downward to a support surface (e.g., to the floor (as shown in the illustrated embodiment)). Additionally or alternatively, the extension member 351*b* may extend to any number of other support surface, such as a support surface on a table or bench, etc., in a manner that provides additional support to the fixture and/or to the workpiece secured therein.

The fixture 350*b* may include a fixture plate 352*b* that may be sized and configured for securing one or more workpiece thereto. Generally, the fixture plate 352*b* may have any number of suitable orientations relative to the vise 100 and/or relative to the one or more other portions of the fixture 350*b* (e.g., relative to the elongated member 340*b*). Hence, for example, the workpiece may be secured to the fixture 350*b* in a manner that any number of suitable surfaces or center of gravity of the workpiece has suitable orientations relative to the support surface (e.g., relative to the floor, support surface of the bench, etc.) that can provide addition support to the workpiece (in addition to the support provided by the vise 100).

While the foregoing is directed to embodiments of the present invention, other and further embodiments of the invention may be devised without departing from the basic scope thereof, and the scope thereof is determined by the claims that follow.

What is claimed is:

1. A pivotable vise, comprising:

a mounting bracket including:

a mounting plate sized and configured to be secured to a support;

a guide plate secured to the mounting plate and having an opening extending therethrough;

a clamping assembly pivotably secured to the mounting bracket and configured to pivot about a pivot axis relative to the mounting bracket, the pivot axis being offset from the opening and the clamping assembly including:

an elongated bar pivotably secured to the mounting bracket, the elongated bar extending lengthwise generally along the pivot axis;

a movable jaw operably connected to the elongated bar;

a back jaw operably connected to the elongated bar; and a locking mechanism configured to secure the elongated bar at a selected angle relative to the guide plate of the mounting bracket, at least a portion of the locking mechanism extending through the opening that is offset from the pivot axis.

2. The pivotable vise of claim 1, wherein:

the opening of the guide plate includes a channel offset from the pivot axis; and the locking mechanism is configured to move within the channel of the guide plate.

3. The pivotable vise of claim 2, wherein the channel has a semi-circular shape centered substantially about the pivot axis.

4. The pivotable vise of claim 2, wherein the locking mechanism includes a nut and bolt assembly configured to clamp together and secure the elongated bar to the guide plate.

5. The pivotable vise of claim 1, wherein the mounting bracket includes a back plate positioned opposite to the guide plate, and the elongated bar is pivotably secured to the back plate and to the guide plate.

6. The pivotable vise of claim 5, wherein the back plate and the guide plate are removably secured to the mounting plate.

7. The pivotable vise of claim 6, wherein the back plate and the guide plate are reversibly secured to the mounting plate.

8. The pivotable vise of claim 2, wherein the clamping assembly includes a stationary head that is fixedly secured to the elongated bar and pivotable with the elongated bar, and the movable jaw is operably connected to a stationary head.

9. The pivotable vise of claim 8, wherein:

the stationary head includes a pivot arm secured to the stationary head such that pivoting the pivot arm pivots the stationary head and the elongated bar; and the locking mechanism is configured to secure the pivot arm to the guide plate, and a portion of the locking mechanism extends through the pivot arm and the channel.

10. The pivotable vise of claim 8, wherein the stationary head includes a nut and a vise screw, and the movable jaw is operably connected to the vise screw.

11. The pivotable vise of claim 1, wherein the clamping assembly includes a repositionable head that is selectively securable to the elongated bar along a length thereof, and the back jaw is operably connected to a stationary head.

12. The pivotable vise of claim 1, wherein the movable jaw and the back jaw include clamping surfaces that are generally parallel to each other and generally perpendicular to the pivot axis.

13. The pivotable vise of claim 1, further comprising one or more clamping attachments removably secured to one or more of the back jaw or the movable jaw.

14. The pivotable vise of claim 13, wherein at least one of the one or more clamping attachments includes one or more stabilizers extending under the elongated bar of the clamping assembly.

15. The pivotable vise of claim 13, wherein at least one of the one or more clamping attachments includes a pivotable clamping including a clamping surface that is pivotable about a jaw axis.

16. The pivotable vise of claim 15, wherein the jaw axis is substantially perpendicular to the pivot axis.

17. The pivotable vise of claim 13, wherein the one or more clamping attachments include two cup-shaped jaws.

18. The pivotable vise of claim 17, further comprising a fixture including a semispherical portion sized and configured to be clamped between the cup-shaped jaws.

19. The pivotable vise of claim 17, further comprising a fixture including an elongated portion and opposing semispherical portions defining opposing ends of the elongated portion and sized and configured to be clamped between the cup-shaped jaws.

20. A clamping system, comprising:

the vise according to claim 1 secured to the support.

* * * * *